US007606506B2

(12) United States Patent
Takahashi

(10) Patent No.: US 7,606,506 B2
(45) Date of Patent: Oct. 20, 2009

(54) IMAGE FORMING APPARATUS

(75) Inventor: Tomohiro Takahashi, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 596 days.

(21) Appl. No.: 11/514,249

(22) Filed: Sep. 1, 2006

(65) Prior Publication Data

US 2007/0053705 A1 Mar. 8, 2007

(30) Foreign Application Priority Data

Sep. 5, 2005 (JP) ..... 2005-255787

(51) Int. Cl.
*G03G 15/08* (2006.01)

(52) U.S. Cl. ..... 399/27; 399/28; 399/29; 399/61

(58) Field of Classification Search ..... 399/27–29, 399/61

See application file for complete search history.

(56) References Cited

U.S. PATENT DOCUMENTS 5,592,270 A * 1/1997 Takai et al. ..... 399/61
7,092,648 B2 * 8/2006 Choi ..... 399/27
2006/0029405 A1 * 2/2006 Tanaka et al. ..... 399/27

FOREIGN PATENT DOCUMENTS

JP 08-314253 11/1996

* cited by examiner

*Primary Examiner*—David M Gray
*Assistant Examiner*—Ryan D Walsh
(74) *Attorney, Agent, or Firm*—Smith, Gambrell & Russell, LLP

(57) ABSTRACT

In an image forming apparatus, in each of a cyan image forming unit, a magenta image forming unit, a yellow image forming unit, and a black image forming unit, during a non-development period during which no toner is discharged out of a development unit, when toner in the development unit is agitated with an agitation roller, every time the drive time of a development motor for driving the agitation roller is counted, the drive time is stored on an accumulative basis in an EEPROM; with respect to the developer unit of which the drive time has become equal to or longer than a predetermined period, a predetermined amount of toner is supplied thereto and the predetermined amount of toner is discharged therefrom, and thereafter the stored drive time is reset.

2 Claims, 3 Drawing Sheets

IMAGE FORMING APPARATUS

This application is based on Japanese Patent Application No. 2005-255787 filed on Sep. 5, 2005, the contents of which are hereby incorporated by reference.

BACKGROUND OF THE INVENTION

1. Field of the Invention

The present invention relates to an image forming apparatus such as a copier, a printer, or a facsimile machine, and more particularly to a technology for preventing degradation of toner image quality therein.

2. Description of Related Art

JP-A-H8-314253 discloses and proposes an image forming apparatus provided with: toner consumption means that forcibly consumes toner accommodated in a developer container of a developing device; and control means that controls the toner consumption means and toner supply means in such a way that the toner accommodated in the developer container is forcibly consumed and toner is forcibly supplied thereto when developer (including toner and carrier) has been agitated for a predetermined period or longer without any consumption of the toner accommodated in the developer container.

According to the image forming apparatus disclosed in JP-A-H8-314253, since the toner accommodated in the developer container is forcibly consumed and toner is forcibly supplied thereto when the developer (including toner and carrier) has been agitated for a predetermined period or longer, it is possible to prevent degradation of the toner resulting from friction between the toner and the carrier agitated in the developer container.

However, the image forming apparatus disclosed in JP-A-H8-314253 is so structured that the period for which the developer (including toner and carrier) has been agitated without any consumption of the toner accommodated in the developer container is not stored in memory means. Hence, if the power to the apparatus is turned off before the period for which the developer has been agitated without any consumption of toner accommodated in the developer container reaches the predetermined period and then the power to the apparatus is turned back on, the period for which developer has been agitated without any consumption of the toner accommodated in the developer container starts to be counted from scratch. Thus, the length of time required for that period to be found to have reached the predetermined period may become longer than it should be. Hence, it may occur that, although the period for which the developer has been agitated without any consumption of the toner accommodated in the developer container is not yet found to have reached the predetermined period, in fact a toner image is formed on paper with degraded toner. This degrades the quality of the toner image formed on the paper.

In addition, JP-A-H8-314253 does not describe in detail the counting of the period for which the developer has been agitated without any consumption of the toner accommodated in the developer container in a case where development accompanying printing (that is, consumption of toner) takes place before that period has reached the predetermined period.

In view of the above described problems, an object of the present invention is to provide an image forming apparatus that is free from the loss of the count result of the period for which toner has been agitated without any discharge of toner out of a development unit, even when the power to the apparatus is once turned off, and that thereby prevents degradation of toner image quality.

SUMMARY OF THE INVENTION

In view of the above described problems, an object of the present invention is to provide an image forming apparatus that is free from the loss of the count result of the period for which toner has been agitated without any discharge of toner out of a development unit, even when the power to the apparatus is once turned off, and that thereby prevents degradation of toner image quality.

To achieve the above object, according to the present invention, an image forming apparatus is provided with: a development unit in which toner is accommodated, the development unit including an agitator for agitating the toner, and a development roller to which a predetermined development bias voltage is applied; the development unit performing development by making the toner adhered to the development roller, to which the predetermined development bias voltage is applied, attach to a latent image formed on a surface of an image carrier; a driver for driving the agitator; a toner supply portion for supplying toner to the development unit; a time counter for counting a drive time of the driver while the development unit is not performing development; a drive-time-storage controller that, each time the time counter counts the drive time, stores the drive time on an accumulative basis in an electrically rewritable nonvolatile memory; a toner discharge portion for discharging out of the development unit the toner accommodated therein; and a toner supply/discharge controller that performs toner supply/discharge control such that, when the drive time stored in the nonvolatile memory reaches or exceeds a predetermined period, the toner supply portion supplies a predetermined amount of toner to the development unit and that the toner discharge portion discharges the predetermined amount of toner out of the development unit. Here, the drive-time-storage controller resets the drive time stored in the nonvolatile memory after the toner supply/discharge controller performs the toner supply/discharge control.

With this structure, even when the power to the apparatus is switched from ON to OFF, it is possible to save from being lost the count result of the drive time of the driver during the non-development period. Also, it is possible to prevent degradation of the toner in the development unit resulting from friction caused by agitation by the agitator during the non-development period, and thereby to prevent degradation of the quality of the toner image printed on paper.

According to the present invention, the image forming apparatus structured as described above may be further provided with: a discharged-toner-amount measurement portion for measuring an amount of discharged toner discharged out of the development unit when the development is performed; and a discharged-toner-amount-storage controller that, each time the discharged-toner-amount measurement portion measures the amount of discharged toner, stores the amount of discharged toner on an accumulative basis in the nonvolatile memory. Here, the toner supply/discharge controller makes the toner supply portion supply the development unit with as much toner as the amount of discharged toner, and when the amount of discharged toner stored in the nonvolatile memory on an accumulative basis reaches or exceeds a predetermined threshold value, the discharged-toner-amount-storage controller resets the amount of discharged toner stored in the nonvolatile memory and also the drive-time-storage controller resets the drive time stored in the nonvolatile memory.

With this structure, the drive time stored on an accumulative basis in the nonvolatile memory is reset when toner is discharged out of the development unit during development, and this eliminates wasteful discharge of toner out of the development unit.

As described above, in the image forming apparatus according to the present invention, even when the power thereto is switched off, it is possible to save from being lost the count result of the drive time during the non-development period. It is also possible to prevent degradation of the toner in the development unit resulting from friction caused by agitation by the agitator during the non-development period, and thereby to prevent degradation of the quality of the toner image printed on paper.

DETAILED DESCRIPTION OF PREFERRED EMBODIMENTS

Figure 1:
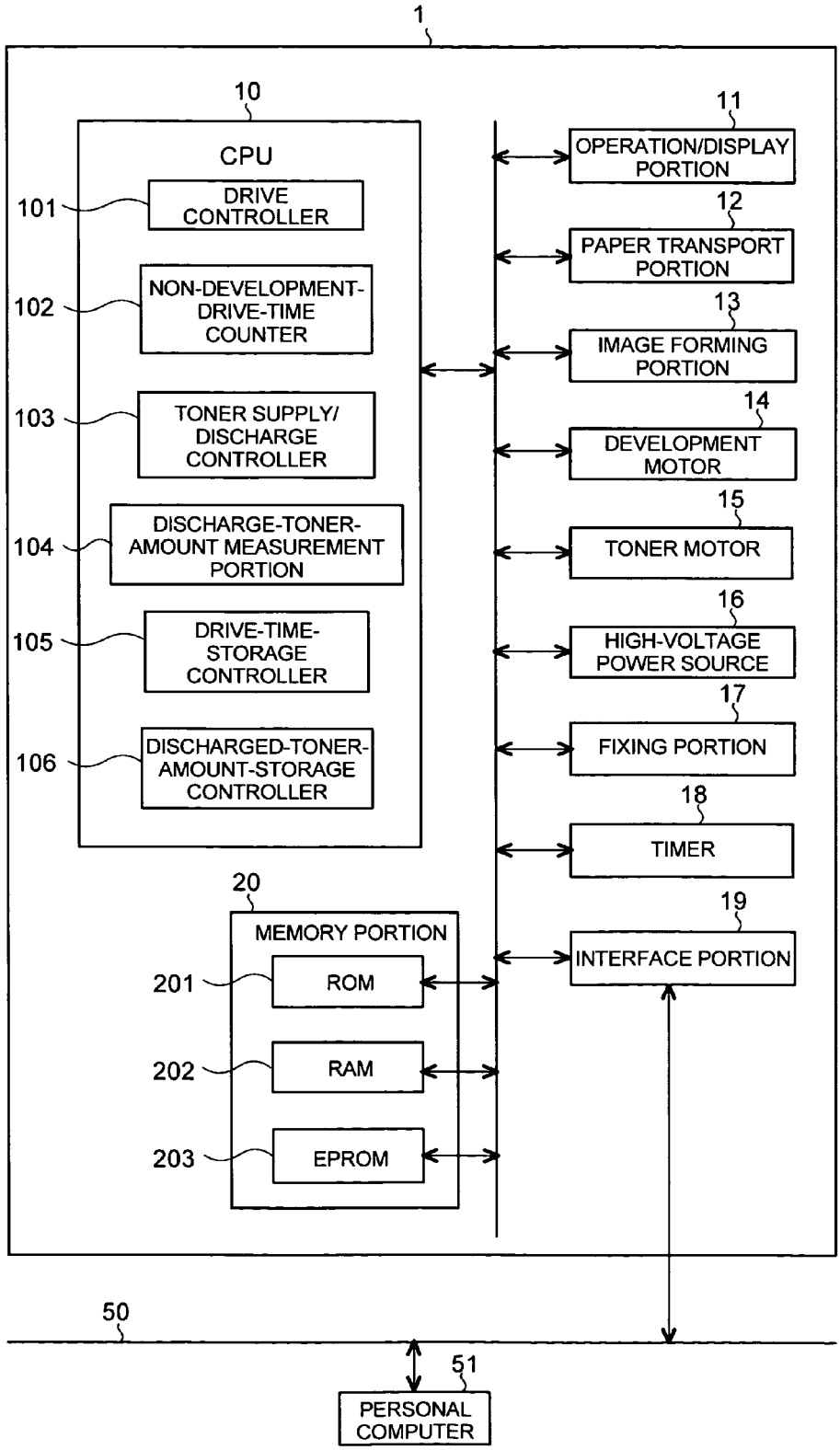
FIG. 1 is a block diagram showing the structure of a principal portion of an image forming apparatus of the present invention.
Figure 2:
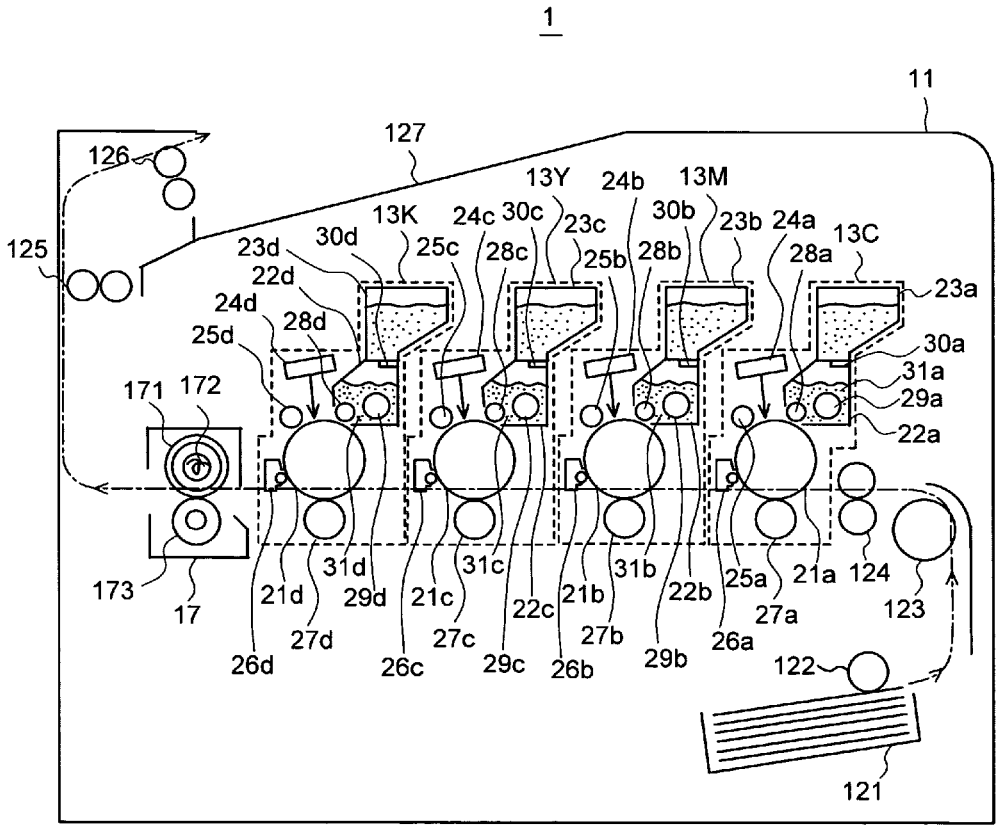
FIG. 2 is a vertical sectional view schematically showing the structure of a principal portion of the image forming apparatus of the present invention.

Hereinafter, an embodiment of the present invention will be described in detail that deals with a case in which the present invention is applied to a tandem-type color image forming apparatus. FIG. 1 is a block diagram showing the structure of a principal portion of an image forming apparatus of the present invention. FIG. 2 is a vertical sectional view schematically showing the structure of a principal portion of the image forming apparatus of the present invention.

As shown in FIGS. 1 and 2, the image forming apparatus 1 of this embodiment is provided with: a central processing unit 10 (hereinafter referred to as the CPU 10) for controlling the operation of the whole apparatus; an operation/display portion 11 composed of an operation section (such as a numeric keypad, a touch panel, and a power switch) and a display section (such as a liquid crystal display); an image forming portion 13 for forming on paper a color or a monochrome toner image based on image data; a paper transport portion 12 for transporting paper; development motors 14, fitted one to each of agitation rollers 29*a* to 29*d*, for driving the agitation rollers 29*a* to 29*d* fitted to development units 22*a* to 22*d* (described later), respectively; toner motors 15, fitted one to each of shutters 30*a* to 30*d*, for opening and shutting the shutters 30*a* to 30*d* for the purpose of supplying toner from toner containers 23*a* to 23*d* corresponding to the development units 22*a* to 22*d* (described later), respectively; a high-voltage power source 16 for applying a predetermined development bias voltage to each of development rollers 28*a* to 28*d* (described later); a fixing portion 17 for fixing on paper a toner image formed by the image forming portion 13; timers 18 each for counting the drive time of one of the development motors 14 while the predetermined development bias voltage is not being applied to the development rollers and hence development is not being performed; an interface portion 19 connected to a network 50 in order to establish communication with outside devices; and a memory portion 20 for storing a variety of control programs and data, and also for use as a work area.

The CPU 10 controls the operation of the whole apparatus, and also is provided with drive a controller 101, a non-development-drive-time counter 102, a toner supply/discharge controller 103, a discharged-toner-amount measurement portion 104, a drive-time-storage controller 105, and a discharged-toner-amount-storage controller 106. The drive controller 101, the non-development-drive-time counter 102, the toner supply/discharge controller 103, the discharged-toner-amount measurement portion 104, the drive-time-storage controller 105, and the discharged-toner-amount-storage controller 106 perform control in the following way with respect to each of a cyan image forming unit 13C, a magenta image forming unit 13M, a yellow image forming unit 13Y, and a black image forming unit 13K.

The drive controller 101 controls the development motors 14. The non-development-drive-time counter 102 makes the timers 18 count the drive times of the development motors 14 while the predetermined development bias voltage is not being applied to the development roller and hence no development is being performed.

The drive-time-storage controller 105 controls such that, each time the non-development-drive-time counter 102 makes the timer 18 count the drive times of the development motors 14 while the development units 22*a* to 22*d* corresponding to each thereof is not performing development, the drive-time-storage controller 105 stores the drive time on an accumulative basis in a predetermined memory area of an EEPROM (electrically erasable and programmable read only memory) 203 (described later), which is an electrically rewritable nonvolatile memory. The drive-time-storage controller 105 resets (that is, erases) the drive time stored in the EEPROM 203 after the toner supply/discharge controller 103 (described later) performs toner supply/discharge control. The drive-time-storage controller 105 also resets (that is, erases) the drive time stored in the EEPROM 203 when the amount of discharged toner stored on an accumulative basis in the nonvolatile memory reaches or exceeds a predetermined threshold value.

The toner supply/discharge controller 103 performs control with respect to the supply of toner to each of the development units 22*a* to 22*d* from the toner containers 23*a* to 23*d* corresponding thereto, respectively, and also performs control with respect to the discharge of toner out of each of the development units 22*a* to 22*d*. The toner supply/discharge controller 103, when the drive time of a particular development motor 14 stored on an accumulative basis in the EEPROM 203 reaches or exceeds a predetermined period, also makes a toner supply portion (in this embodiment, the toner motors 15, the toner containers 23*a* to 23*d*, and the shutters 30*a* to 30*d*) supply a predetermined amount of toner to the development unit corresponding to the development motor 14 and performs toner supply/discharge control such that a toner discharge portion (in this embodiment, the development units 22*a* to 22*d* involved in development, photoconductive drums 21*a* to 21*d*, and the like) is made to discharge a predetermined amount of toner out of the development unit.

The discharged-toner-amount measurement portion 104 performs control so as to measure the amount of toner discharged out of each of the development units 22*a* to 22*d* during development. The discharged-toner-amount-storage controller 106, each time the discharged-toner-amount measurement portion 104 measures the amount of discharged toner, performs control so as to store the amount of discharged toner on an accumulative basis in the EEPROM 203. Also, the discharged-toner-amount-storage controller 106 resets (that is, erases) the amount of discharged toner stored in the EEPROM 203 when the amount of discharged toner stored on an accumulative basis in the nonvolatile memory reaches or exceeds a predetermined threshold value.

Incidentally, to facilitate understanding of the description, in FIG. 1, the drive controller 101, the non-development-drive-time counter 102, the toner supply/discharge controller 103, the discharged-toner-amount measurement portion 104, the drive-time-storage controller 105, and the discharged-toner-amount-storage controller 106 are each illustrated as an individual block. However, in practice, the processing in the drive controller 101, the non-development-drive-time counter 102, the toner supply/discharge controller 103, the discharged-toner-amount measurement portion 104, the drive-time-storage controller 105, and the discharged-toner-amount-storage controller 106 is performed on a software basis by the CPU 10.

Since the above described drive controller 101, non-development-drive-time counter 102, toner supply/discharge controller 103, discharged-toner-amount measurement portion 104, drive-time-storage controller 105, and discharged-toner-amount-storage controller 106 represent control performed by the CPU 10 on a software basis, they will hereinafter be described as operations performed by the CPU 10.

The memory portion 20 is provided with: a ROM (read only memory) 201 in which a variety of control programs and the like are stored; a RAM (random access memory) 202 for use as a work area; and the EEPROM 203 that is electrically rewritable and in which, each time the CPU 10 makes the timers 18 count the drive times of the development motors 14, the current total value thereof is stored on an accumulative basis.

Each time the CPU 10 measures the amount of toner discharged out of the development units 22*a* to 22*d*, the CPU 10 stores the amount of discharged toner on an accumulative basis in the EEPROM 203. The EEPROM 203 may be any electrically rewritable nonvolatile memory (for example, a flash memory).

As shown in FIG. 2, the paper transport portion 12 is provided with: a paper feed cassette 121 for storing sheets of paper; a paper feed roller 122 for feeding paper one by one out of the paper feed cassette 121; a transport roller 123 for transporting the paper fed by the paper feed roller 122 to resist rollers 124 (described later); resist rollers 124 composed of a pair of rollers for adjusting the orientation of the paper fed from the transport roller 123 and for controlling the timing for starting the transport of the paper so as to transport the paper to the image forming portion 13; transport rollers 125 composed of a pair of rollers for transporting the paper fed through the fixing portion 17 to ejection rollers 126 (described later); ejection rollers 126 composed of a pair of rollers for ejecting out of the apparatus the paper transported from the transport rollers 125; and a paper ejection tray 127 onto which the paper is ejected.

The fixing portion 17 is provided with: a fixing roller 171; a fixing heater 172 arranged inside the fixing roller 171 for heating the fixing roller 171; and a press roller 173. The fixing roller 171 and the press roller 173 are kept in contact with each other so as to form a nip portion for nipping paper. In the fixing portion 17, the heating roller 171 is heated by the fixing heater 172 so as to heat paper while the paper is passing through the nip portion, thereby fusing the toner that has been transferred to the paper, and then the press roller 173 presses the paper so as to fix the toner on the paper.

The image forming portion 13, as shown in FIG. 2, is provided with, on the paper transport passage from the resist rollers 124 to the fixing portion 17: the cyan image forming unit 13C for forming a cyan toner image on paper; the magenta image forming unit 13M for forming a magenta toner image on paper; the yellow image forming unit 13Y for forming a yellow toner image on paper; and the black image forming unit 13K for forming a black toner image on paper, in this order from the resist roller 124 side.

As shown in FIG. 2, the cyan image forming unit 13C, the magenta image forming unit 13M, the yellow image forming unit 13Y, and the black image forming unit 13K are provided with: photoconductive drums 21*a* to 21*d*, respectively, built as image carriers for carrying cyan, magenta, yellow, and black toner images, respectively, based on image data on the surfaces thereof; chargers 25*a* to 25*d*, respectively, for uniformly charging the surfaces of the photoconductive drums 21*a* to 21*d*, respectively, with a predetermined potential; exposure units 24*a* to 24*d*, respectively, for forming electrostatic latent images on the surfaces of the photoconductive drums 21*a* to 21*d*, respectively, by irradiating them with laser light based on image data; the development units 22*a* to 22*d*, respectively, for developing cyan, magenta, yellow, and black toner images, respectively, by making cyan, magenta, yellow, and black toner adhere to the electrostatic latent images formed on the surfaces of the photoconductive drums 21*a* to 21*d*, respectively; the toner containers 23*a* to 23*d*, respectively, for accommodating cyan, magenta, yellow, and black toner, respectively, which is to be supplied to the development units 22*a* to 22*d*, respectively; transfer rollers 27*a* to 27*d*, respectively, for electrostatically transferring the toner images formed on the surfaces of the photoconductive drums 21*a* to 21*d* onto paper transported thereto; and cleaning portions 26*a* to 26*d*, respectively, for collecting toner remaining on the surfaces of the photoconductive drums 21*a* to 21*d*, respectively.

As shown in FIG. 2, the development units 22*a* to 22*d* contain inside thereof cyan, magenta, yellow, and black two-component developers 31*a* to 31*d*, respectively, including nonmagnetic toner and magnetic carrier. The development units 22*a* to 22*d* are provided with: the agitation rollers 29*a* to 29*d*, respectively, for agitating toner and carrier to electrically charge the toner through friction with the carrier; the development rollers 28*a* to 28*d*, respectively, to which a predetermined development bias voltage is applied by a high-voltage power source 16 to attract toner and that supply charged toner to the photoconductive drums 21*a* to 21*d*, respectively, on each of which is formed an electrostatic latent image; and the shutters 30*a* to 30*d*, respectively, which are, when toner is supplied to the development units 22*a* to 22*d*, each opened and shut by one of the toner motors 15 corresponding to the development units 22*a* to 22*d*.

A personal computer 51 (unillustrated) connected to the network 50 stores a variety of programs, data, and the like, and is provided with a memory portion that is also used as a work area, a display for displaying images, a user input device on which the user performs input operations, a control portion that controls the whole personal computer 51, an interface that establishes communication with outside devices, and the like. The personal computer 51 can send and receive data, print data, and the like to and from outside devices such as the image forming apparatus 1.

Next, an image forming operation (printing operation) performed in the image forming apparatus 1 structured as described above will be described with reference to FIGS. 1 and 2. The arrowed broken line in FIG. 2 indicates the paper transport passage. The image forming operation in the image forming apparatus 1 of this embodiment is performed as follows. When the interface portion 19 receives print data from the personal computer 51, the CPU 10 temporarily stores the print data in the memory portion 20. The print data is then read from the memory portion 20 to extract image data therefrom, which is sent to the image forming portion 13. At this time, paper is fed out of the paper feed cassette 121 by the paper feed roller 122 and is transported further to the transport roller 123. The paper transported to the transport roller 123 is further transported to the resist rollers 124 by the transport roller 123.

Subsequently, in the image forming portion 13, on the surfaces of the photoconductive drums 21*a* to 21*d* uniformly charged at a predetermined electric potential by the chargers 25*a* to 25*d*, respectively, electrostatic latent images based on the image data are formed by the exposure units 24*a* to 24*d*, respectively.

Subsequently, in the cyan image forming unit 13C, development is performed by the development unit 22*a* permitting cyan toner to adhere to the electrostatic latent image formed on the photoconductive drum 21*a*. Then, when the paper that has been transported by the resist rollers 124 passes through the nip portion formed where the photoconductive drum 21*a* and the transfer roller 27*a* come in contact with each other, the cyan toner image is transferred onto the paper by the transfer roller 27*a* to which a predetermined transfer bias voltage is applied.

Subsequently, in the magenta image forming unit 13M, development is performed by the development unit 22*b* permitting magenta toner to adhere to the electrostatic latent image formed on the photoconductive drum 21*b*. When the paper that has passed through the cyan image forming unit 13C passes through the nip portion formed where the photoconductive drum 21*b* and the transfer roller 27*b* come in contact with each other, the magenta toner image is transferred onto the paper by the transfer roller 27*b* to which a predetermined transfer bias voltage is applied.

Subsequently, in the yellow image forming unit 13Y, development is performed by the development unit 22*c* permitting yellow toner to adhere to the electrostatic latent image formed on the photoconductive drum 21*c*. When the paper that has passed through the magenta image forming unit 13M passes through the nip portion formed where the photoconductive drum 21*c* and the transfer roller 27*c* come in contact with each other, the yellow toner image is transferred onto the paper by the transfer roller 27*c* to which a predetermined transfer bias voltage is applied.

Subsequently, in the black image forming unit 13K, development is performed by the development unit 22*d* permitting black toner to adhere to the electrostatic latent image formed on the photoconductive drum 21*d*. When the paper that has passed through the yellow image forming unit 13Y passes through the nip portion formed where the photoconductive drum 21*d* and the transfer roller 27*d* come in contact with each other, the black toner image is transferred onto the paper by the transfer roller 27*d* to which a predetermined transfer bias voltage is applied.

The paper on which the cyan, magenta, yellow, and black toner images based on the image data are transferred in this order in the cyan image forming unit 13C, the magenta image forming unit 13M, the yellow image forming unit 13Y, and the black image forming unit 13K in this way is then transported to the fixing portion 17. After the paper is heated and pressed by the fixing portion 17 to fix the toner images on the paper, the paper is transported to the transport rollers 125. Then, the transport rollers 125 transport the paper to the ejection rollers 126, which eject the paper onto the paper ejection tray 127.

As described above, in the image forming apparatus of this embodiment, in each of the cyan image forming unit 13C, the magenta image forming unit 13M, the yellow image forming unit 13Y, and the black image forming unit 13K, development is performed by permitting cyan, magenta, yellow, and black toner adhered to the development rollers 28*a* to 28*d* to which the predetermined development bias voltage is applied, respectively, to attach to the electrostatic latent images formed one on each of the surfaces of the photoconductive drums 21*a* to 21*d*, respectively. Furthermore, the image forming apparatus 1 of this embodiment is characterized in that effective control for preventing degradation of the toner accommodated in the development units 22*a* to 22*d* is achieved in the following way: each time the drive times of the development motors 14 for driving the agitation rollers 29*a* to 29*d*, respectively, are counted when the developers 31*a* to 31*d* (including toner and carrier) are agitated by the agitation rollers 29*a* to 29*d*, respectively, while development is not being performed with no toner being discharged out of the development units 22*a* to 22*d*, the counted drive times of the development motors 14 are stored on an accumulative basis in the EEPROM 203, and after a predetermined amount of toner is supplied to and discharged out of whichever development unit whose agitation roller corresponds to any one of the development motors 14 the drive time of which has reached or exceeded a predetermined period, the drive time stored in the EEPROM 203 corresponding to that one of the development motors 14 is reset.

Figure 3:
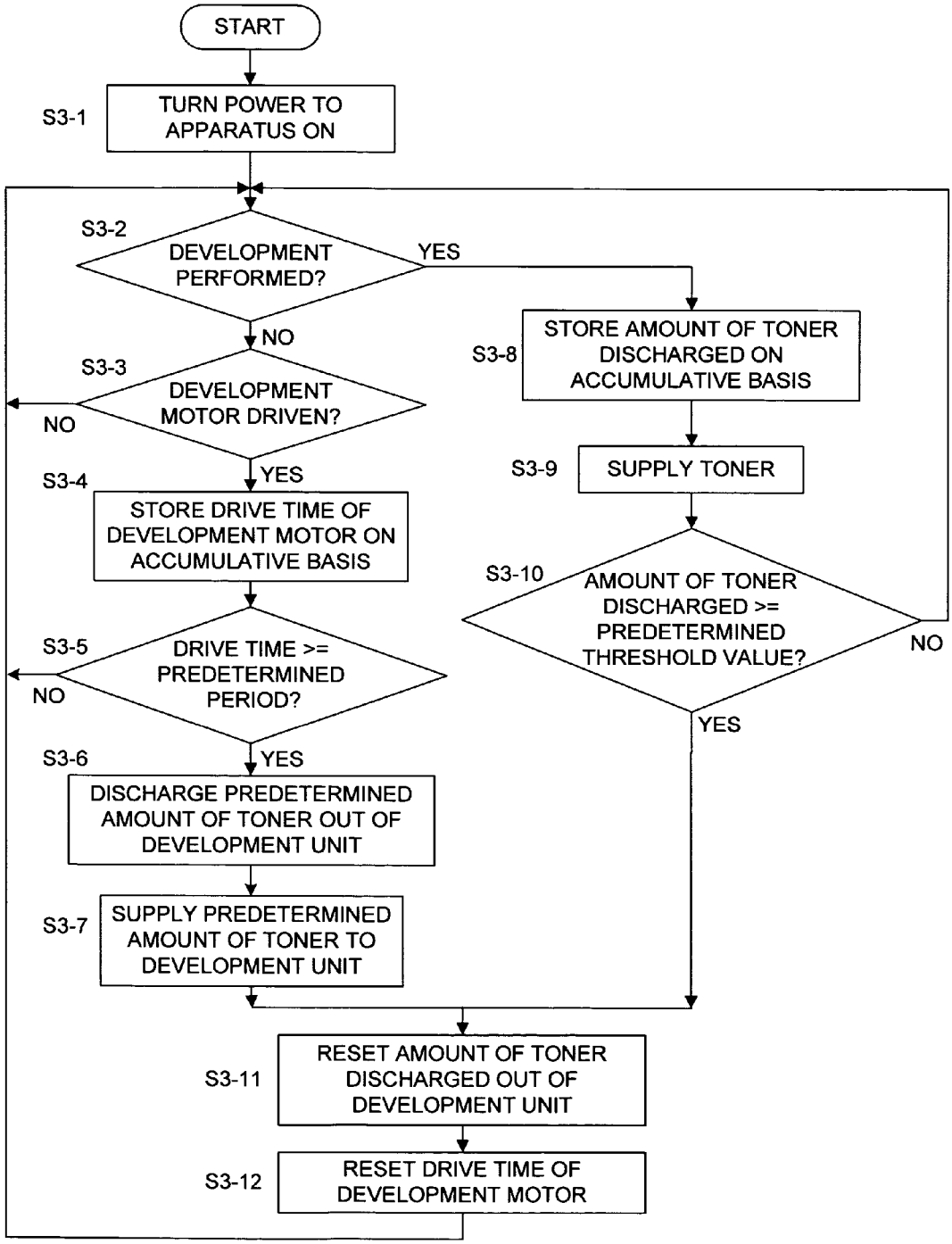
FIG. 3 is a flow chart illustrating an example of how degradation of toner in the development unit is prevented in the image forming apparatus embodying the present invention.

Hereinafter, the above feature of the image forming apparatus 1 of this embodiment will be described in detail with reference to the relevant drawings. FIG. 3 is a flow chart illustrating an example of how degradation of toner in a development unit is prevented in the image forming apparatus of this embodiment. Since in the image forming apparatus 1 of this embodiment, with respect to the cyan image forming unit 13C, the magenta image forming unit 13M, the yellow image forming unit 13Y, and the black image forming unit 13K, similar control is performed so as to prevent degradation of cyan, magenta, yellow, and black toner accommodated in the development units 22*a* to 22*d*, respectively, the control will be described with respect only to the cyan image forming unit 13C.

In the image forming apparatus of this embodiment, when the user presses a power switch (unillustrated) to turn the power to the apparatus on in step S3-1, the power is supplied to relevant parts of the apparatus from a power supply portion (unillustrated). Then, according to the control programs stored in the ROM 201, the CPU 10 checks the operation of each portion of the apparatus.

Subsequently, in step S3-2, when, in the cyan image forming unit 13C, no electrostatic latent image is formed by the control of the CPU 10 on the surface of the photoconductive drum 21*a* and the CPU 10 finds the situation to be such that the predetermined development bias voltage is not applied to the development roller 28*a* by the high-voltage power source16 and hence no development is performed (S3-2, NO), the processing proceeds to step S3-3 where, when the one of the development motors 14 corresponding to the development unit 22*a* is found to have been driven by the control of the CPU 10 (S3-3, YES), the processing proceeds to step S3-4.

When, in step S3-3, the one of the development motors 14 corresponding to the development unit 22*a* is found not to have been driven by the control of the CPU 10 (S3-3, NO), the processing returns to step S3-2.

Subsequently, in step S3-4, the CPU 10 makes the timer 18 count the drive time of the development motor 14, which is the period from the development motor 14 starts being driven till it stops being driven. Then, the CPU 10 stores the counted drive time of the drive motor 14 during the non-development period on an accumulative basis in a predetermined memory area of the EEPROM 203.

Subsequently, in step S3-5, when the CPU 10 finds the drive time, stored on an accumulative basis in the EEPROM 203, of the development motor 14 during the non-development period to have reached or exceeded a predetermined period (for example, one minute) (S3-5, YES), the processing proceeds to step S3-6, where, by the control of the CPU 10, development is performed in such a way that an electrostatic latent image is formed to permit a predetermined amount of toner to adhere to the surface of the photoconductive drum 21*a* and the predetermined development bias voltage is applied to the developing roller 28*a* by the high-voltage power source 16 for a period necessary for the predetermined amount of toner to adhere to the surface of the photoconductive drum 21*a*. In this way, the predetermined amount of toner out of the development unit 22*a* adheres to the surface of the photoconductive drum 21*a*, and this permits the predetermined amount of toner to be discharged out of the development unit 22*a*. The predetermined amount of toner adhered to the surface of the photoconductive drum 21*a* during development is not transferred to paper but is removed and collected by the cleaning portion 26*a*. When the development motor 14 is driven to activate the agitation roller 29*a* while development is not being performed, the toner included in the developer 31*a* accommodated in the development unit 22*a*, which is heated by the heat from the fixing portion 17, starts to be degraded by the friction resulting from the agitation caused by the agitation roller. When printing is performed on paper using the degraded toner, the quality of toner images formed on paper starts to be degraded at some point in time. The predetermined period in step S3-5 corresponds to the total drive time, up to the just-mentioned point in time, of the development motor 14 while development is not being performed.

In step S3-5, when the CPU 10 finds the drive time of the development motor 14 during the non-development period, which the CPU 10 has stored on an accumulative basis in the EEPROM 203, to be less than the predetermined period (for example, one minute) (S3-5, NO), that is, when degradation of the toner in the development unit 22*a* has been found not to have advanced, the processing returns to step S3-2.

Subsequently, in step S3-7, the CPU 10 controls so as to drive one of the toner motors 15 corresponding to the shutter 30*a*, thereby permitting the shutter 30*a* to be opened for a period necessary for a predetermined amount of toner to be supplied from the toner container 23*a* to the development unit 22*a*, and thus the predetermined amount of toner is supplied from the toner container 23*a* to the development unit 22*a*. Then, the processing proceeds to step S3-11. Incidentally, the data of the period necessary for the predetermined amount of toner to be supplied from the toner container 23*a* to the development unit 22*a* are previously obtained from an experiment or the like and stored in the ROM 201. A sensor capable of detecting the amount of toner supplied from the toner container 23*a* to the development unit 22*a* may be fitted to the development unit 22*a* so as to detect whether or not the predetermined amount of toner has been supplied from the toner container 23*a* to the development unit 22*a*.

The predetermined amount of toner in steps S3-6 and S3-7 corresponds to, for example, an amount of toner that allows a printing ratio of 2 to 4% to be achieved, assuming that the printing ratio is 100% when a toner image is formed all over a sheet of A4 paper.

When, in step S3-2, the CPU 10 recognizes that, in the cyan image forming unit 13C, development is being performed, when the toner electrically adhered to the development roller 28*a* to which the predetermined development bias voltage is applied by the high-voltage power source 16 attaches to an electrostatic latent image formed by the control of the CPU 10 on the surface of the photoconductive drum 21*a* based on image data (S3-2, YES), the processing proceeds to step S3-8, where the amount of toner discharged out of the development unit 22*a* during development is measured based on the image data by the CPU 10 as the total amount of the toner that is discharged out of the development unit 22*a* so as to adhere to the photoconductive drum 21*a*. Then, the CPU 10 stores the measured amount of discharged toner on an accumulative basis in a predetermined memory area of the EEPROM 203.

Subsequently, in step S3-9, the CPU 10 controls so as to drive the one of the toner motors 15 corresponding to the shutter 30*a*, thereby permitting the shutter 30*a* to be opened for a period necessary for as much toner as the amount of toner that has been found in step S3-8 to have been discharged to be supplied from the toner container 23*a* to the development unit 22*a*, and thus as much toner as the amount of discharged toner is supplied from the toner container 23*a* to the development unit 22*a*.

Subsequently, in step S3-10, when the CPU 10 finds the amount of toner discharged out of the development unit 22*a* during development as stored on an accumulative basis in the EEPROM 203 to be equal to a predetermined threshold value or more (S3-10, YES), then the processing proceeds to step S3-11, where the CPU 10 resets the amount of toner discharged out of the development unit 22*a* as stored on an accumulative basis in the EEPROM 203. The predetermined threshold value in step S3-10 corresponds to the previously-mentioned amount of toner, i.e., the amount of toner with which it was possible to save toner accommodated in the development unit 22*a* from being degraded when toner was discharged out of the development unit 22*a* during the non-development period when the development motor 14 was driven (S3-2, NO; S3-3, YES).

When, in step S3-10, the CPU 10 finds the amount of toner discharged out of the development unit 22*a* during development as stored on an accumulative basis in the EEPROM 203 to be less than the predetermined threshold value (S3-10, NO), the processing returns to step S3-2.

Subsequently, in step S3-11, the CPU 10 resets the amount of toner discharged out of the development unit 22*a* as stored on an accumulative basis in the EEPROM 203.

Subsequently, in step S3-12, the CPU 10 resets the total drive time, stored on an accumulative basis in the EEPROM 203, of the development motor 14, and the processing returns to step S3-2, and then the processing is continued according to the flow chart.

In the case where the processing proceeds through step S3-7 on to step S3-11, in step S3-11, the CPU 10 resets the amount of toner discharged out of the development unit 22*a* stored on an accumulative basis in the EEPROM 203, and this saves the length of time required for the drive time of the development motor 14 stored on an accumulative basis in the EEPROM 203 to be reset from becoming longer, and thus degradation of toner accommodated in the development unit 22*a* can be prevented more effectively.

In the case where the processing proceeds through step S3-10 YES and step S3-11 to step S3-12, the drive time of the development motor 14 stored on an accumulative basis in the EEPROM 203 is reset in step S3-12. This lengthens the length of time required for the processing to return to step S3-2 and proceed through steps to step S3-6, and thereby eliminates wasteful discharge of toner.

Incidentally, the control performed with respect to the cyan image forming unit 13C in the image forming apparatus 1 as described above with reference to the flow chart in FIG. 3 is also performed with respect to the magenta image forming unit 13M, the yellow image forming unit 13Y, and the black image forming unit 13K.

As described above, in the image forming apparatus 1 of this embodiment, in each of the cyan image forming unit 13C, the magenta image forming unit 13M, the yellow image forming unit 13Y, and the black image forming unit 13K, each time the drive times of the development motors 14 for driving the agitation rollers 29*a* to 29*d*, respectively, are counted during the period during which the toner accommodated in the development units 22*a* to 22*d* is agitated by the agitation rollers 29*a* to 29*d*, respectively, while development is not being performed with no toner being discharged out of the development units 22*a* to 22*d*, the counted drive times are stored on an accumulative basis in the EEPROM 203. Moreover, after a predetermined amount of toner is supplied to and discharged out of any of the development units 22*a* to 22*d* whose drive time has reached or exceeded a predetermined period of time, the corresponding drive time stored in the EEPROM 203 is reset.

Hence, in the image forming apparatus 1 of this embodiment, even when the power to the image forming apparatus 1 is switched from ON to OFF, it is possible to prevent the count result of the drive time of the development motor 14 during the non-development period from being lost. It is also possible to save the toner included in the developer 31*a* accommodated in the development unit 22*a*, which is heated by the heat from the fixing portion 17, from being degraded by the friction resulting from the agitation by the agitation roller 29*a* driven by the development motor 14 during the non-development period, and thereby to prevent degradation of the quality of the toner image printed on paper.

The image forming apparatus 1 of the embodiment described above is structured such that two-component developer including toner and carrier is accommodated in each development unit. However, it may be structured such that only toner is accommodated in each development unit so as to perform development. The latter structure is as advantageous as the former.

In the embodiment described above, a tandem-type color image forming apparatus capable of outputting color images is dealt with; in practice, the present invention finds wide application in all types of image forming apparatuses capable of outputting color images and monochrome image forming apparatuses.

In the embodiment described above, the image forming apparatus shown in FIGS. 1 and 2 is dealt with; in practice, the present invention finds wide application in image forming apparatuses in general such as facsimile machines, copiers, and MFPs (multifunction peripherals).

The present invention may be practiced otherwise than specifically described above, with various modifications and variations made within the spirit of the invention.

What is claimed is:

1. An image forming apparatus, comprising:

a development unit in which toner is accommodated, the development unit including an agitator for agitating the toner and, a development roller to which a predetermined development bias voltage is applied, the development unit performing development by making the toner adhered to the development roller, to which the predetermined development bias voltage is applied, attach to a latent image formed on a surface of an image carrier;

a driver for driving the agitator;

a toner supply portion for supplying toner to the development unit;

a time counter for counting a drive time of the driver while the development unit is not performing development;

a drive-time-storage controller that, each time the time counter counts the drive time, stores the drive time on an accumulative basis in an electrically rewritable nonvolatile memory;

a toner discharge portion for discharging out of the development unit the toner accommodated therein; and a toner supply/discharge controller that performs toner supply/discharge control such that, when the drive time stored in the nonvolatile memory reaches or exceeds a predetermined period, the toner supply portion supplies a predetermined amount of toner to the development unit and that the toner discharge portion discharges the predetermined amount of toner out of the development unit, wherein the drive-time-storage controller resets the drive time stored in the nonvolatile memory after the toner supply/discharge controller performs the toner supply/discharge control.

2. The image forming apparatus of claim 1, further comprising:

a discharged-toner-amount measurement portion for measuring an amount of discharged toner discharged out of the development unit when the development is performed; and a discharged-toner-amount-storage controller that, each time the discharged-toner-amount measurement portion measures the amount of discharged toner, stores the amount of discharged toner on an accumulative basis in the nonvolatile memory, wherein the toner supply/discharge controller makes the toner supply portion supply the development unit with as much toner as the amount of discharged toner, and when the amount of discharged toner stored in the nonvolatile memory on an accumulative basis reaches or exceeds a predetermined threshold value, the discharged-toner-amount-storage controller resets the amount of discharged toner stored in the nonvolatile memory and also the drive-time-storage controller resets the drive time stored in the nonvolatile memory.

* * * * *